US010144628B1

(12) United States Patent
Hardy et al.

(10) Patent No.: US 10,144,628 B1
(45) Date of Patent: Dec. 4, 2018

(54) APPARATUS AND METHOD FOR COLLECTION AND DISPOSAL OF WASTE-WATER AND DEBRIS FROM AIR CONDITIONERS AND OTHER SOURCES

(71) Applicants: Michael A Hardy, White Plains, NY (US); Scott C Cackowski, Stamford, CT (US)

(72) Inventors: Michael A Hardy, White Plains, NY (US); Scott C Cackowski, Stamford, CT (US)

(73) Assignee: Crossford International, LLC, Stamford, CT (US)

( * ) Notice: Subject to any disclaimer, the term of this patent is extended or adjusted under 35 U.S.C. 154(b) by 172 days.

(21) Appl. No.: 13/999,444

(22) Filed: Feb. 26, 2014

Related U.S. Application Data

(60) Provisional application No. 61/850,999, filed on Feb. 27, 2013.

(51) Int. Cl.
*B67C 11/02* (2006.01)
*B65D 33/14* (2006.01)

(52) U.S. Cl.
CPC ..... *B67C 11/02* (2013.01); *B65D 33/14* (2013.01)

(58) Field of Classification Search
CPC ..... B67C 11/02; B65D 33/14; B08B 13/00; B08B 9/032; F28G 13/00; F28G 15/00; F28G 9/00
USPC ..... 62/304; 15/257.3, 257.1; 134/104.2
See application file for complete search history.

(56) References Cited

U.S. PATENT DOCUMENTS 4,622,027 A * 11/1986 Parish ..... B65D 90/24 383/41
5,899,217 A * 5/1999 Testman, Jr. ..... B08B 17/00 134/104.2
6,125,647 A * 10/2000 Martinez ..... E04D 13/08 62/285
6,863,116 B1 * 3/2005 Kane ..... B08B 17/00 15/104.03
6,990,987 B1 * 1/2006 Smith ..... B08B 9/0323 134/104.2
9,259,769 B1 * 2/2016 Kane ..... F28G 15/00
9,476,658 B1 * 10/2016 Rojas ..... F28G 1/166
2003/0024552 A1 * 2/2003 Watanabe ..... B08B 3/02 134/26
2012/0273014 A1 * 11/2012 Tadayon ..... B08B 15/02 134/166 R

FOREIGN PATENT DOCUMENTS

CN 201277684 * 7/2009
CN 201744470 * 2/2011
JP 411325502 A * 11/1999
JP 2000179888 A * 6/2000
JP 2000279897 A * 10/2000

(Continued)

*Primary Examiner* — Jason K Niesz
*Assistant Examiner* — James Hakomaki
(74) *Attorney, Agent, or Firm* — Patrick J Walsh

(57) ABSTRACT

A device for collecting waste cleaning fluid and debris from an installed A/C unit by placing and supporting a funnel shaped collection bib under the A/C unit by means of device mounting brackets placed behind the A/C unit, the bib being held open by an arcuate rib attached to the mounting brackets, and by a supporting cord passing through the rib, brackets, and bib hem and being cinched against the device.

9 Claims, 8 Drawing Sheets

(56) References Cited

FOREIGN PATENT DOCUMENTS

| | | | | | |
|---|---|---|---|---|---|
| JP | 2001012897 | A | * | 1/2001 | |
| JP | 02001027498 | A | * | 1/2001 | |
| JP | 2005098662 | A | * | 4/2005 | |
| JP | 2005274114 | A | * | 10/2005 | |
| JP | 2012002450 | A | * | 1/2012 | |
| TW | 425006 | U | * | 3/2012 | |
| WO | WO 2010064924 | A1 | * | 6/2010 | ..... F25B 47/00 |
| WO | WO 2012100282 | A1 | * | 8/2012 | ..... B08B 3/04 |

* cited by examiner

APPARATUS AND METHOD FOR COLLECTION AND DISPOSAL OF WASTE-WATER AND DEBRIS FROM AIR CONDITIONERS AND OTHER SOURCES

RELATIONSHIP TO OTHER APPLICATIONS AND PATENTS

This application claims priority of a U.S. Provisional Application Ser. No. 61/850,999, dated Feb. 27, 2013, the entire contents of which are relied upon and are fully incorporated herein by reference.

BACKGROUND OF THE INVENTION

The present invention is directed to the art of cleaning the fins of air conditioning units, and in particular to disposal of water and cleaner fluids used in the course of cleaning the units. The air conditioning units with which the invention is used provide heated or cooled air for an interior living space according to season of the year. The invention may also be applied in the collection and disposal of liquids and fluids from similar cleaning operations.

In order to maintain thermodynamic efficiency in air conditioning units it is necessary periodically to clean the condenser tube surfaces and fins. Room air conditioning units of concern here are situated in residences and offices in close proximity to furniture, residents, and office workers, so care and finesse are needed to clean air conditioning coils in these settings.

The present invention is directed to an apparatus and method for collecting fluids from cleaned A/C units and for directing such fluids to a floor drain or sewer, or to a collection container for later disposal. In other applications, the invention may be used for collection and disposal of fluid and related debris when leaks occur, or equipment fails and so forth.

SUMMARY OF THE INVENTION

In accordance with the apparatus and method of the present invention, water and cleaning fluid from an A/C unit are collected in a large flexible plastic bib which is conical or funnel shaped having its large open end positioned near the unit and its small open end positioned to direct water and fluid toward a floor drain or to collection in a container such as a five-gallon bucket.

In a preferred arrangement of the invention, the bib is held open by an arcuate rib removably attached to side brackets inserted behind the A/C unit. A supporting cord is fitted with cord clamps to maintain the wide open bib in front of and under the A/C unit so as to catch and dispose of cleaning water and fluid draining from the fins in a cleaning operation. The side brackets slide into the space between an A/C unit casing and the wall supporting the unit. The open collection bib is positioned centrally of the fins being cleaned and the bib is cinched up and under the A/C unit along the joint between unit and wall so as to place the bib under the entire A/C unit. When so positioned the collection bib catches water and cleaning fluid exiting from the fins and drains the water and fluid to a floor drain adjacent the A/C unit or to a portable bucket.

In this way the A/C unit is cleaned and cleaning water fluid is disposed of in an efficient and tidy manner without soiling nearby room furniture, and without the need to move the A/C unit or furnishings from their usual places.

Specific examples are included in the following description for purposes of clarity, but various details can be changed within the scope of the present invention.

OBJECTS OF THE INVENTION

An object of the invention is to provide an apparatus and method for collecting and draining away waste-water in an A/C fin and tube cleaning operation, especially for mini-split units located in a residence or office.

Other and further objects of the invention will become apparent with an understanding of the following detailed description of the invention or upon employment of the invention in practice.

BRIEF DESCRIPTION OF THE DRAWING DRAWINGS

A preferred embodiment of the invention has been chosen for detailed description to enable those having ordinary skill in the art to which the invention appertains to readily understand how to construct and use the invention and is shown in the accompanying drawings wherein.

DETAILED DESCRIPTION OF THE PREFERRED EMBODIMENT

Figure 1:
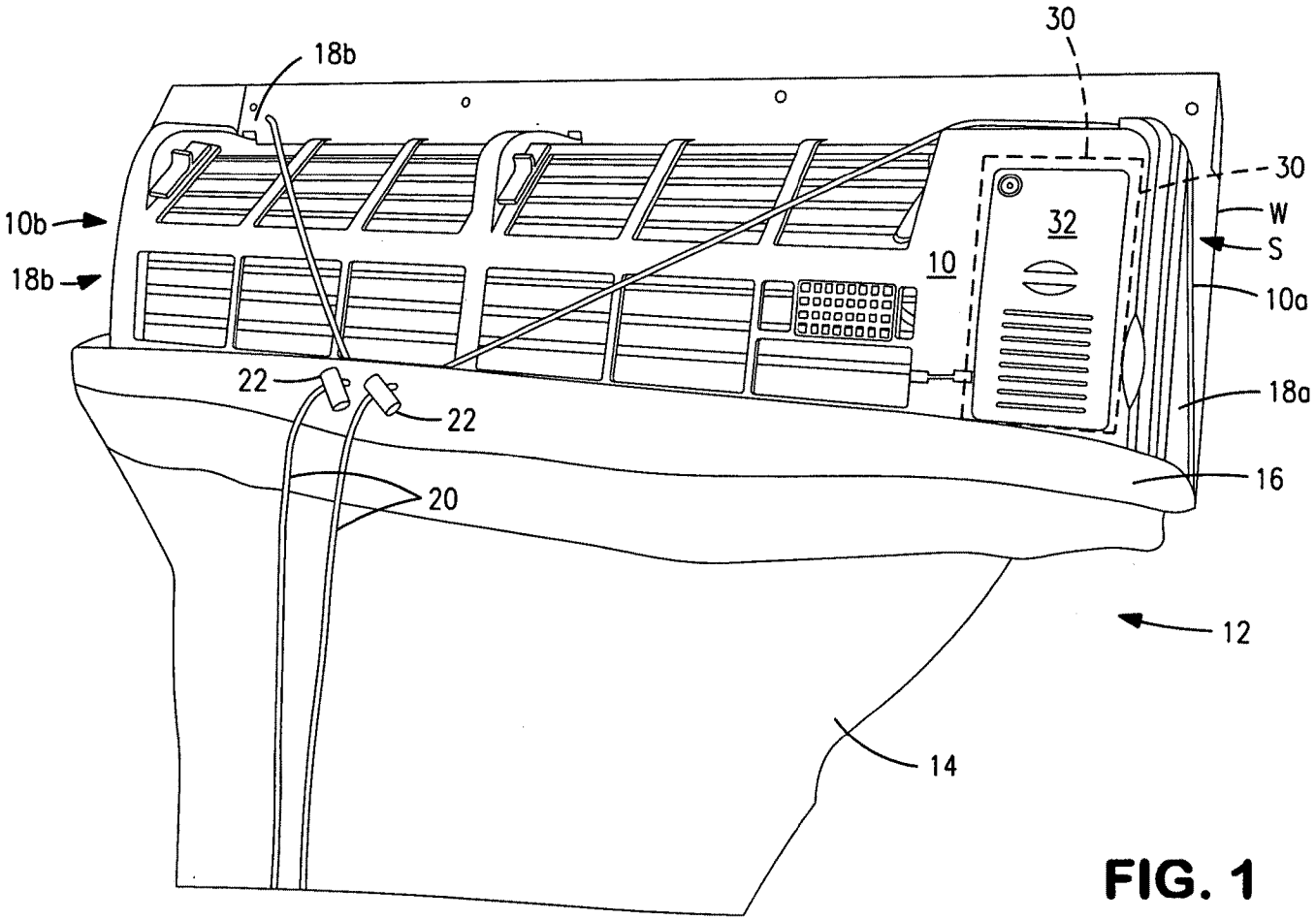
FIG. 1 is a front corner elevation view showing a device of the present invention including a funnel shape open-end collecting bib with a wide opening and a supporting rib positioned through a hem formed around the opening, side mount brackets, and an adjustable cord for supporting the device on an A/C unit.
Figure 2:
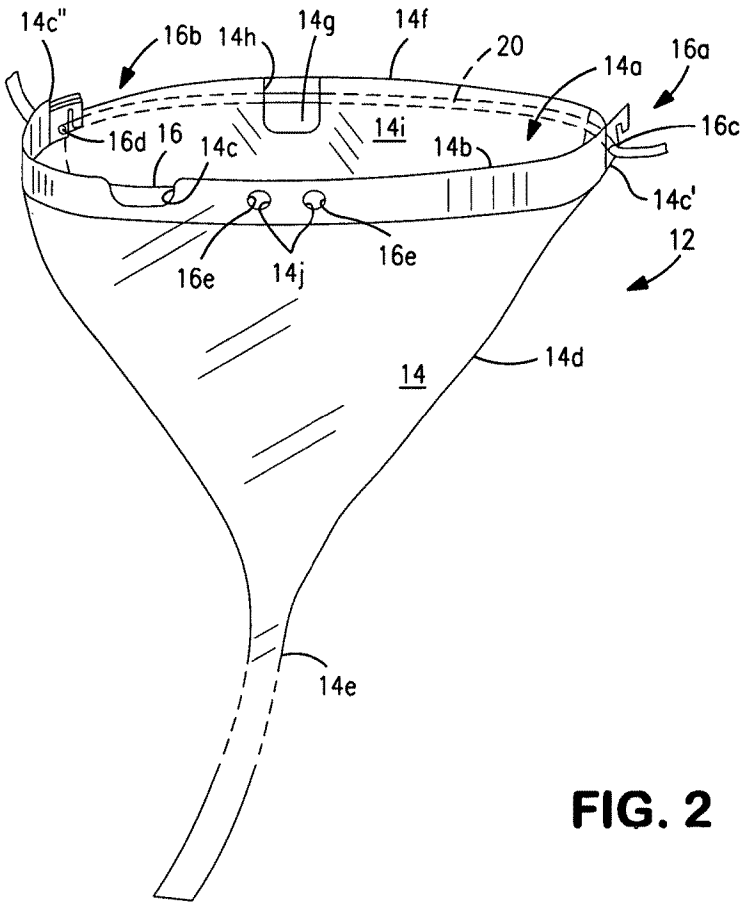
FIG. 2 is a perspective view of a collection bib and supporting rib ready to be placed in position on an A/C unit for collecting cleaning fluid and debris during coil cleaning.

Referring now to FIGS. 1 through 8, the apparatus and method of the invention have particular application to mini-split A/C units 10 mounted through a wall W in a residence or an office leaving a space S between unit and wall along opposite rear side edges 10*a-b* of the unit. Mini-split units have a determinable range of width, height, and depth as can be judged from the installed unit shown in FIG. 1 of the drawing. The apparatus of the invention is adjustable in its design and construction to accommodate mini-split units sized in such determinable range.

Referring to FIGS. 1-4 of the drawing, a device 12 for collection and disposal of waste cleaning fluid and debris from an A/C unit comprises a collection bag or bib 14, an arcuate rib 16 for holding the bib open and mounting it in operating position, a pair of mounting brackets 18*a-b* held in the space S between unit and supporting wall W, and a supporting and retaining cord 20 with cord clamps 22 for holding bib and rib in position while A/C coils are cleaned.

The collection means comprises a large flexible impermeable plastic bib in the general shape of a funnel with large entry opening 14*a* with marginal hem 14*b* to define a rib receiving passage 14*c*, a conical body 14*d* converging into an elongate lower end duct 14*e* leading waste fluid and debris to a drain line or collection container such as a five gallon bucket. The bib opening is hemmed 14*b* over a front arcuate portion of the opening to define rib receiving passage 14*c* open at each end 14*c*', 14*c*". A rib inserted into the passage projects through each open end to expose rib end hooks 16*a-b*, and cord apertures 16*c-d* seen best in FIG. 5.

The bib opening 14*a* includes a back margin 14*f* extending between hem openings 14*c*', 14*c*", the back margin being defined by a flap 14*g* of bib folded at the margin to define an elongate inside recess 14*h* within back bib face 14*i* and back flap 14*g*. The elongate recess accommodates a length of supporting cord 20 extending between rib end apertures 16*c-d* for the purpose of positioning and holding the bib back margin 14*f* up and under an A/C unit along a line L (FIG. 3) where the unit underside 10*c* meets supporting wall W.

The rib 16 is a slat preferably made of plastic that may be preformed, or may be flexible to form a variable opening mouth of bib opening 14*a* to accommodate different mini-split units having different widths. Arcuate rib 16 is an elongate strip having ends terminating in a hook 16*a-b* and having a cord aperture 16*c-d*. The rib passes through bib hem 14*b* for spreading the open end of the bib beneath the coils of an A/C unit. The rib and hem have a pair of aligned central apertures 16*e*, 14*j* respectively, midway between the hooked ends with each aperture for receiving an end of the supporting cord 20.

Figure 5:
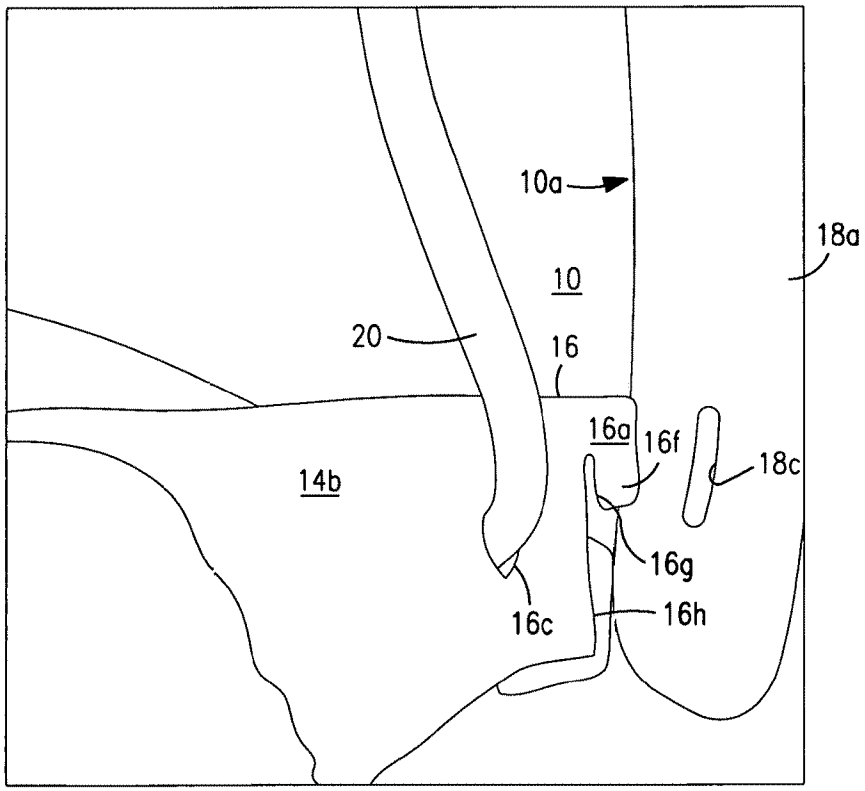
FIG. 5 is a back corner elevation of an A/C unit showing a bib supporting rib end being moved into position in a receptor slit in the lower portion of side mount bracket.

As seen best in FIG. 5, each end of the rib has an opening 16*c-d* for passing the supporting cord and an end hook 16*a-b* defined by tab 16*f* and adjacent slot 16*g* in rib end edge 16*h-i*. The tab fits through a slit 18*c* in a side bracket 18*a-b* and the rib end is moved so that rib slot 16*g* firmly engages slit 18*c* in side bracket wall. When each rib end hook is secured in a side bracket slit, the rib passes through the bib hem in desired arc across the front of the A/C unit holding the bib in wide open position.

Figure 4:
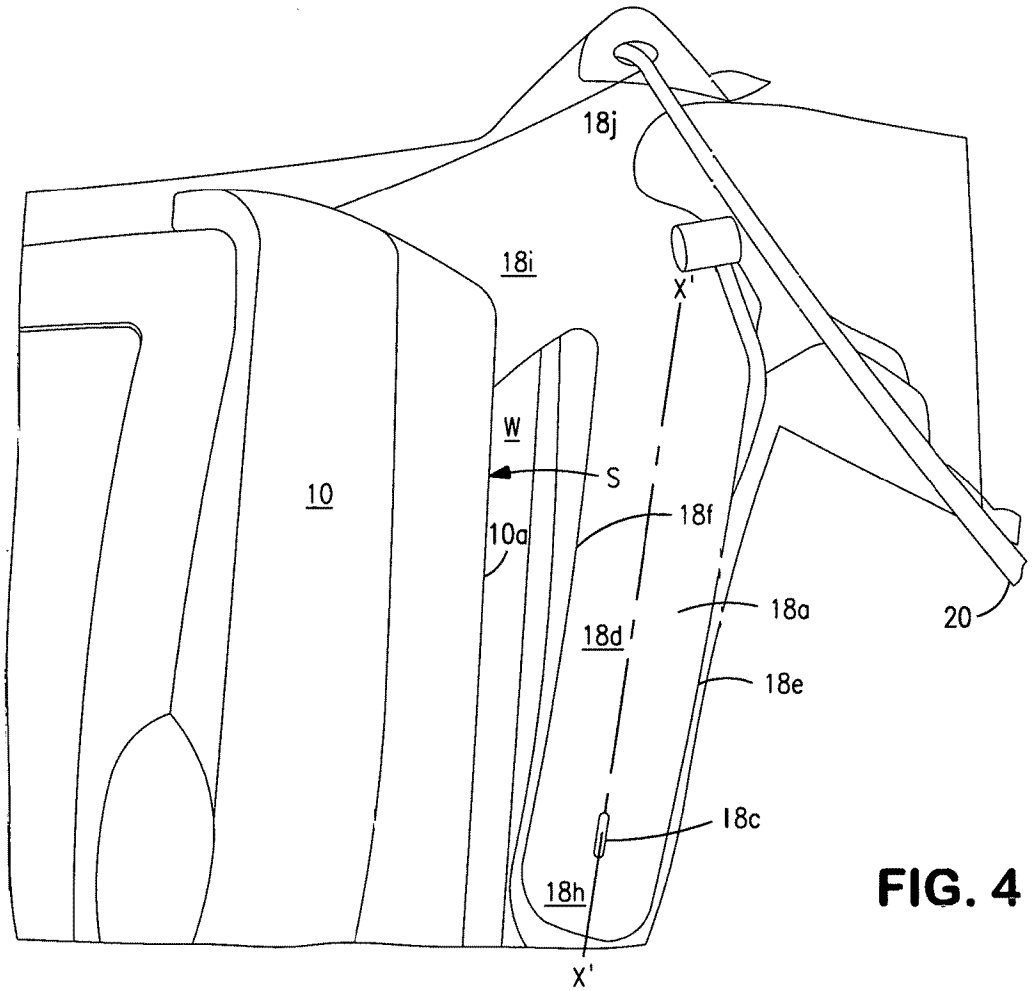
FIG. 4 is a front corner elevation of an A/C unit showing a side mount bracket being moved into position between A/C unit and its supporting wall.
Figure 6:
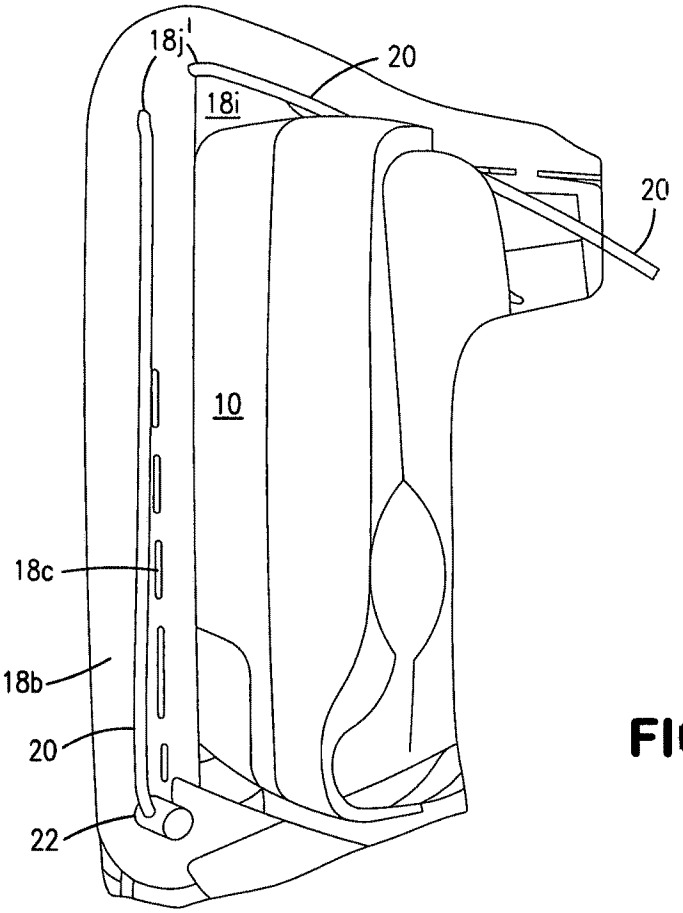
FIG. 6 is a back corner elevation of an A/C unit showing mounting bracket in position and threaded with supporting cord.

Side mount brackets 18*a-b* shown in FIGS. 4-6 are slipped into position in an existing space S between an A/C unit 10 and the unit's supporting wall W. In a preferred embodiment, a side mounting bracket 18*a-b* comprises an elongate plate 18*d* having an axis x-x', side edges 18*e-f*, first and second ends 18*g-h* spaced from each other along the axis, at least a single integral flange 18*i* extending from a side edge at one end of the plate, and a crown 18*j* joined to flange and plate at the one end of the plate. Bracket plate has at least one and preferably a plurality of rib hook receiving means such as slits 18*c*. Bracket crown has at least one and preferably two openings 18*j*' for passing the supporting cord.

Figure 8:
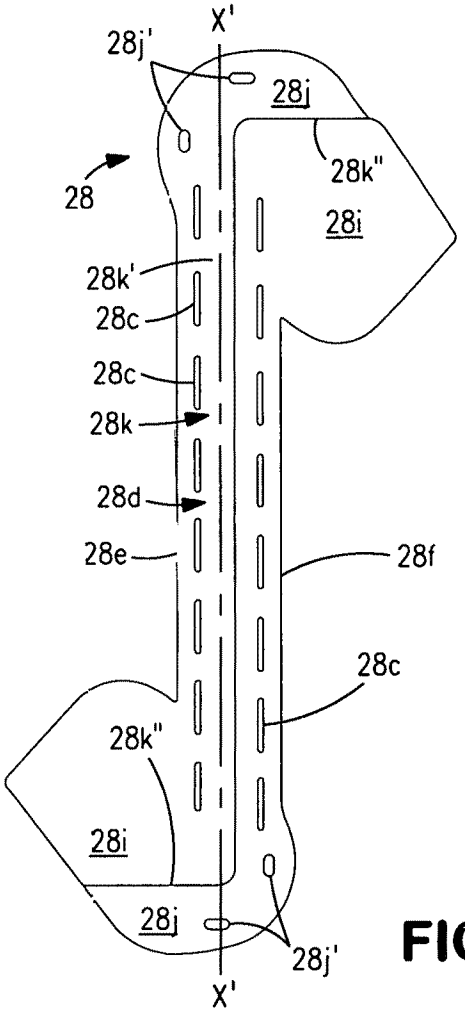
FIG. 8 is a modified embodiment of mounting bracket according to the invention.

In another preferred embodiment shown in FIG. 8, a side mount bracket 28 comprises an elongate plate 28*d* having an axis x-x', side edges 28*e-f*, first and second ends 28*g-h* spaced from each other along the axis, an integral flange 28*i* and crown 28*j* at both ends extending in opposed directions from the axis, and a Z-shape ridge 28*k* including central ridge 28*k*' along the axis and right angle ridges 28*k*" at both ends separating flange and crown. Two rows of slits 28*c* extend axially of the plate on either side of central ridge, and the crown dual cord passing apertures 28*j*'. The preferred embodiment of FIG. 8 comprises a single side bracket configuration that can be used on both the left and right sides 10*a-b* of an A/C unit. The Z-shape ridge serves as a stop for limiting movement of the bracket into space S between A/C unit 10 and supporting wall W so that the bracket exposes slits and openings and provides a necessary base for securing supporting cord 20.

Figure 3:
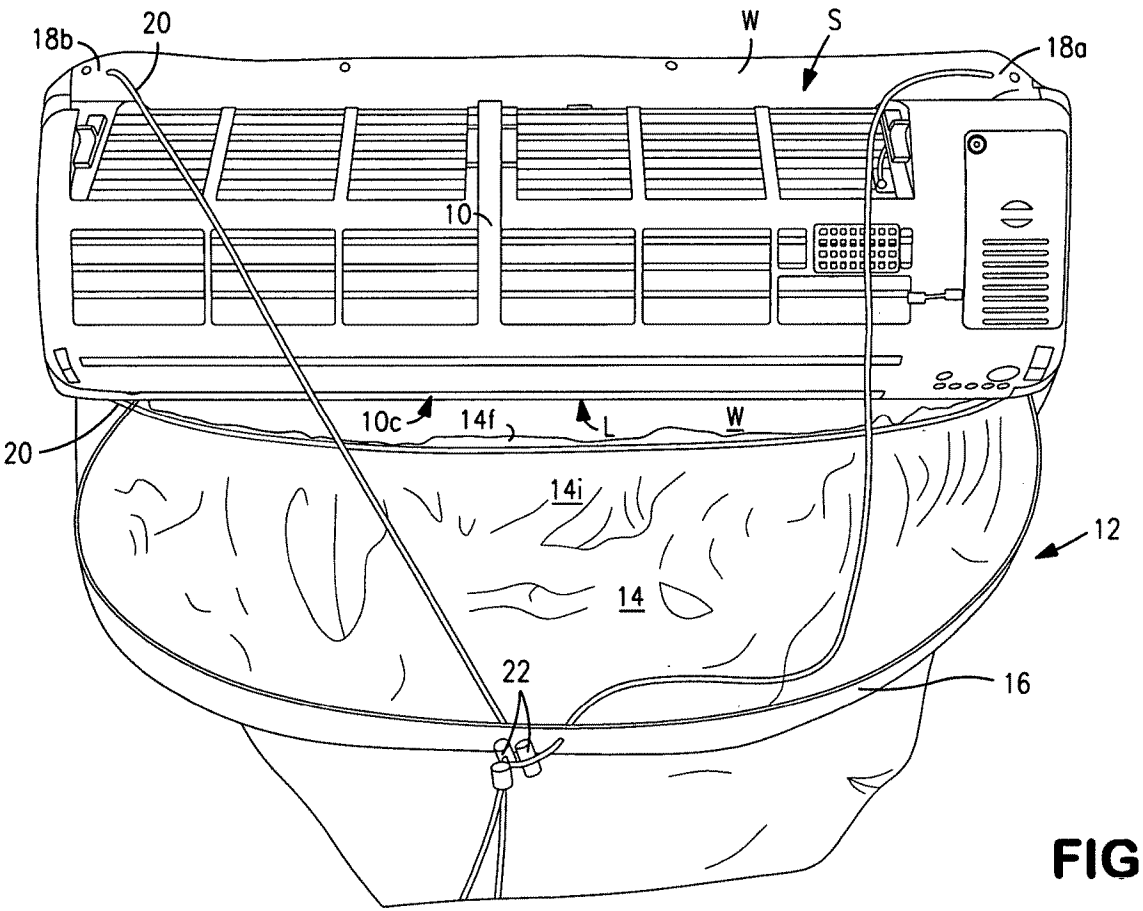
FIG. 3 is a front elevation of the device of FIG. 1 being moved into position on an A/C unit, and the cord for holding the device in preliminary position.
Figure 7:
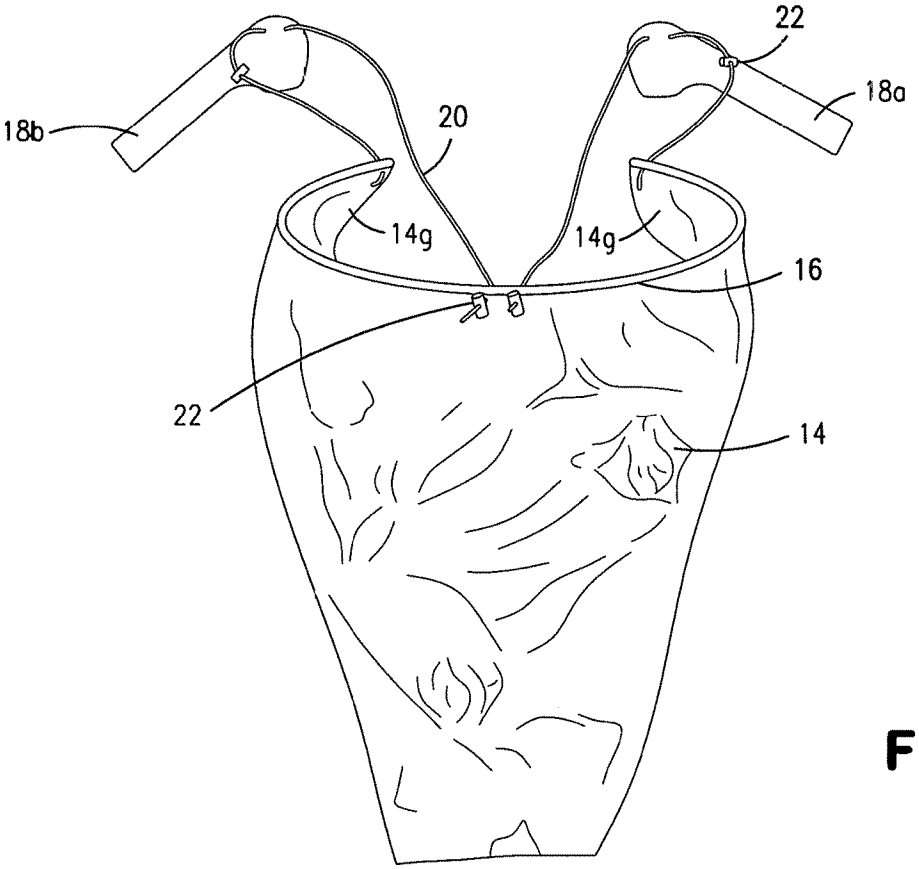
FIG. 7 is an assembly view of apparatus of the invention including bib, rib, side brackets, and supporting cord with cord locks.
Figure 9:
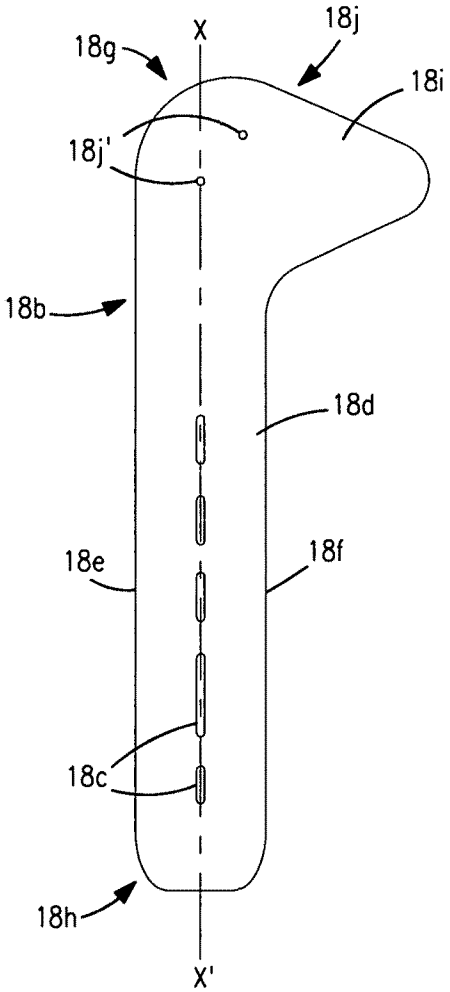
FIG. 9 illustrates full shape of mounting bracket.

A supporting and retaining cord 20 as shown in FIGS. 3 and 7 passes through one rib center aperture 16*e*, through one or both apertures in first mounting bracket 18*a*, through first rib end aperture 16*c*, through the recess 14*h* formed by back flap 14*g* of the bib, through second rib end aperture 16*d*, through one or both apertures in the second mounting bracket 18*b*, and through the other rib center aperture 16*e*. The supporting cord is drawn taut, with inside flap margin of the bib fetched up under the A/C unit joint with the supporting wall, the rib end hooks 16*f* engaged in bracket slits 18*c*, the rib brought to a generally horizontal position, and cord clamps 22 applied at each rib end opening and each rib central opening to hold device 12 firmly to A/C unit for coil cleaning.

It is to be observed that supporting cord 20 as it passes through rib end apertures 16*c*,16*d* acts as a hem retainer wherein the rib end hooks 16*f* are normally exposed and ready for insertion into side bracket slits 18*c*.

FIG. 7 illustrates an assembly of the invention including bib and rib, side brackets, supporting cord threaded from rib left-center aperture, left-side bracket crown apertures, left rib end aperture, through bib back side recess, right rib end aperture, right-side bracket crown apertures, and rib right-center aperture. It is in this assembly the apparatus is sold.

In practice, the device is prepared by assembling the rib in the bib hem, threading the supporting cord through one rib central aperture, one bracket crown aperture, one rib end aperture, the bib inner flap recess, through the other rib end aperture, the other bracket crown aperture, and the other rib central aperture, the rib ends being hooked onto the bracket slits, the cord being drawn tight to secure the bib in place with level (horizontal) opening under the A/C coils, and the slip locks cinched up to the rib to hold the device stationary while coil cleaning proceeds.

A suitable supporting cord is an elastic cord popularly known as a bungee cord. The slip locks are also well-known and slide along the cord to desired position where they are released.

A method according to the invention comprises the steps of placing an impermeable cover 30 on an A/C unit's operating control panel 32, inserting the side brackets between the A/C unit side edges and the supporting wall, opening a funnel shape collection bib with an arcuate rib, deploying the open bib by connecting the rib to each side bracket, supporting the bib underneath the A/C unit at the joint between the unit and the supporting wall, passing the supporting cord through the front of rib and bib, one side bracket, one end of the rib, through the bib underneath the A/C unit, through the other rib end, through the other side bracket, and through the front of the rib and bib, drawing the cord tight to support the bib in position below the A/C unit, and clamping the cord to the rib center and rib ends to hold the cord tight.

Various changes may be made to the structure embodying the principles of the invention. The foregoing embodiments are set forth in an illustrative and not in a limiting sense. The scope of the invention is defined by the claims appended hereto.

We claim:

1. An apparatus for collection of waste fluid and debris from a mini-split air conditioning unit mounted in a supporting wall leaving a space between unit and wall, the air conditioning unit having side edges spaced from the wall and having an underside forming a joint line with the wall, the apparatus comprising a collection bib in the shape of a funnel with an open top end defining a perimeter, the collection bib having a lower duct end, a hem extending along the perimeter of the top end of the bib, the hem having one and another open ends, a supporting cord, a rib extending through the hem for opening the top of the bib, the rib having ends projecting through the one and another hem open ends, each rib end having a cord passing aperture and a hook, the rib further having cord passing apertures midway between the rib ends, the hem having apertures aligned with the apertures midway, the bib open top end having a flap margin extending between rib ends defining a recess for passing the supporting cord to support the bib underneath the air conditioning unit, a pair of side brackets for insertion in the space along the air conditioning unit side edges, each bracket having a plate with spaced ends, a flange projecting from one end the plate, a crown joined to the flange and to the plate, a cord passing aperture in the crown, a slit in the plate for receiving a hooked rib end to support the bib in wide open operating position in front of and beneath the air conditioning unit, the supporting cord passing through the rib and the bib midway apertures, the rib end apertures, the recess, and the bracket crown apertures, the supporting cord pulled taut to hold the bib in operating position, cord locks to hold the supporting cord taut, whereby the bib collects waste cleaning fluid and debris for delivery via the bib lower duct end to a disposal point.

2. An apparatus as defined in claim 1 in which the bib is fabricated of plastic.

3. An apparatus as defined in claim 1 in which the rib is a slat formed in an arcuate shape.

4. An apparatus as defined in claim 3 in which the rib end apertures and supporting cord cooperate to hold the rib end outside the bib hem opening.

5. An apparatus as defined in claim 1 in which each of the side brackets has a ridge to limit insertion into the space.

6. An apparatus as defined in claim 1 in which the pair of side brackets have a plurality of both slits and crown apertures.

7. An apparatus as defined in claim 1 in which each side bracket comprises an elongate plate having an axis, side edges, first and second ends spaced from each other along the axis, a flange and a crown at both ends extending in opposed directions from the axis, and a Z-shape ridge including central ridge along the axis and right angle ridges at said ends separating the flange and the crown, two rows of slits extending axially of the plate on both sides of the central ridge, and the crown having dual cord passing apertures.

8. An apparatus for collection of waste fluid and debris from a mini-split air conditioning unit mounted in a supporting wall leaving a space between unit and wall, the air conditioning unit having side edges spaced from the wall and having an underside forming a joint line with the wall, the apparatus comprising a supporting cord, a collection bib having a lower end duct, an open-ended hem extending along the top end of the bib, a rib extending through the hem for opening the top of the bib, the bib open end having a flap margin extending between rib ends defining a recess for passing the supporting cord to support the bib underneath the air conditioning unit, a pair of side brackets for insertion in the space along said unit side edges, each bracket having a plate with spaced ends, a flange projecting from one end of the plate, a crown above the plate, a cord passing through the aperture in the crown, a means in the plate for receiving a rib end to support the bib in wide open operating position in front of and beneath the air conditioning unit, the supporting cord passing through the rib and the bib, the rib ends, the said recess, and the bracket crown apertures, the supporting cord pulled and held taut to hold the bib in operating position, whereby the bib collects waste cleaning fluid and debris for delivery via the bib lower end duct to a disposal.

9. A method for collecting waste fluid and debris while cleaning coils of a supporting wall mounted air conditioning unit, the method comprising the steps of placing an impermeable cover on air conditioning unit operating control panel, inserting side brackets between the air conditioning unit side edges and the supporting wall, opening a funnel shape collection bib with an arcuate rib, deploying the open bib in front of and beneath the air conditioning unit by connecting the rib to each side bracket, supporting the bib underneath the air conditioning unit at a joint between the unit and the supporting wall, passing a supporting cord through front of the rib and the bib, one side bracket, one end of rib, through the bib underneath the air conditioning unit, through the other rib end, through the other side bracket, and through the front of the rib and the bib, drawing the cord tight to support the bib in position in front of and beneath the air conditioning unit, clamping the cord to the rib center and the rib ends to hold the cord tight while receiving waste fluid and debris from the air conditioning unit in the bib open end, and conducting the fluid and the debris through the bib lower end duct to a disposal point.

* * * * *